United States Patent [19]

Shiff

[11] Patent Number: 4,764,765

[45] Date of Patent: Aug. 16, 1988

[54] BINARY DISPLAY DEVICE TO AID SWITCH SETTING

[75] Inventor: Victor Shiff, Naugatuck, Conn.

[73] Assignee: Timex Corporation, Middlebury, Conn.

[21] Appl. No.: 940,123

[22] Filed: Dec. 10, 1986

[51] Int. Cl.[4] ..... G09G 3/04

[52] U.S. Cl. ..... 340/756; 340/765; 340/815.04

[58] Field of Search ..... 340/756, 762, 765, 520, 340/815.04, 760, 807

[56] References Cited

U.S. PATENT DOCUMENTS

| | | | |
|---|---|---|---|
| 3,965,469 | 6/1976 | Ryan | 340/756 |
| 4,159,471 | 6/1979 | Whitaker | 340/756 |
| 4,246,493 | 1/1981 | Beeghly | 340/520 |

FOREIGN PATENT DOCUMENTS

| | | | |
|---|---|---|---|
| 2824913 | 12/1978 | Fed. Rep. of Germany | 340/756 |
| 0061913 | 4/1982 | Japan | 340/756 |
| 2061586 | 5/1981 | United Kingdom | 340/756 |

*Primary Examiner*—Gerald L. Brigance

*Attorney, Agent, or Firm*—William C. Crutcher

[57] ABSTRACT

A first device having a segmented display for normally displaying information in numeric or alphanumeric form is provided with means to aid the setting of a bank of externally accessible switches on a second device so that they correspond with internal switching data contained in the first device. Segments or groups of segments on the display of the first device are selected in pairs to represent a position of a respective switch on the second device. One of each pair of segments or groups of segments is activated so that appearance of the display corresponds to the desired appearance of the properly set switches in the bank of switches. This aids in setting the switches to the proper positions. For example, each pair of vertically aligned segments in a segmented numeric display represents a switch position. The switch is set on or off depending upon whether the upper or lower segment of each vertical pair is activated. Although not so limited, the invention finds application in setting the external bank of switches in a radio receiver to correspond to a transmitted code signal in a radio transmitter, where the transmitter code switch setting may not otherwise be visible.

21 Claims, 2 Drawing Sheets

BINARY DISPLAY DEVICE TO AID SWITCH SETTING

BACKGROUND OF THE INVENTION

This invention relates generally to display of binary numbers on devices intended to display numbers or alphabetic characters. More particularly, it relates to using the numeric or alphanumeric display of a first device to assist in setting an externally accessible bank of switches in a second device to correspond to an internally set binary code in the first device.

Many applications arise, where a bank of switches must be set to a code which is unique to a particular device. An example is seen in the digital communications field where multiple transmitters and multiple receivers occupy the same communications channel. Here it is desired that one or more selected receivers are receptive only to the transmissions of one or more selected transmitters. In such cases, both transmitter and receiver utilize a "protocol" or transmission frame containing a digital binary code which is unique to both devices. Through this means, the receiver is only receptive to the selected transmitter. Such unique code often takes the form of a binary "word" consisting of a number of binary digits. In order to set the coded word into both the transmitter and receiver, it must be possible to selectively change each bit in the code word. This may be accomplished by an externally accessible bank of switches for each device, in which the 1's and 0's are set by operating toggle switches or DIP switches in the proper sequence. However in many cases the binary word representing the code is not set by individual external switches representing each binary digit, but is contained internally within the device, eg. it may exist only as 1's and 0's in several memory cells of a memory device. Therefore, it becomes difficult to set the binary code word on the one device with externally accessible switches to correspond to the internally contained binary code word in the other device, particularly in the case where the codes are changed frequently on both devices.

Although displays are known for displaying both decimal and binary numerals, the infrequency of making binary settings makes it uneconomic to incorporate both types of displays in a device.

Accordingly, one object of the present invention is to provide an improved means for displaying a binary number on a decimal or alphanumeric display.

Another object of the invention is to provide an improved means for using a numeric display on a first device to set a bank of switches on a second device.

Still another object of the invention is to provide an improved means for externally setting switches for the code in a receiver so that it is receptive to digital communications provided by a transmitter having a decimal numeric display.

SUMMARY OF THE INVENTION

Briefly stated, the invention comprises the improvement in a first device having a segmented display normally displaying information in decimal or alphanumeric form using segmented patterns and also arranged to be used with a second device having externally accessible binary or two position switches, wherein the improvement comprises binary decoding and driving means connected to display a desired binary switch setting for the second device on the display of the first device such that the physical appearance is similar. The first device may thus display a first binary code word to assist in setting an identical second binary dode word into the second device. Switch settings are displayed by actuating segments in paired sets of segments. A set may be a single horizontal segment, a single vertical segment or a group of segments arranged in a closed pattern.

DRAWING

The subject matter which is regarded as the invention, is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

DESCRIPTION OF THE PREFERRED EMBODIMENT

Figure 1:
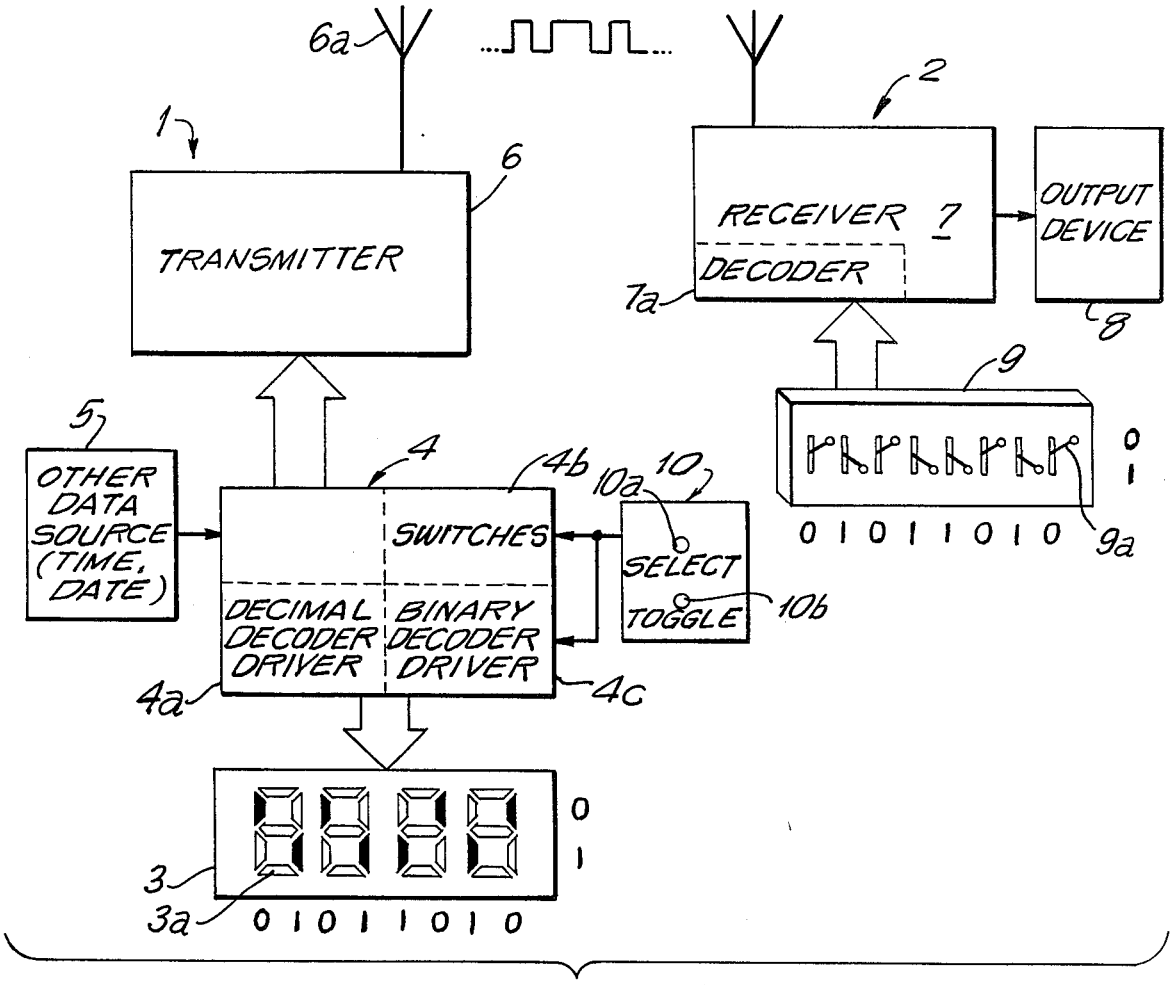
FIG. 1 is a simplified schematic drawing of a transmitter and receiver comprising a digital communications system.

Referring now to FIG. 1 of the drawing, a digital communications system comprises a first device shown generally at 1 and a second device shown generally at 2 in simplified schematic form. First device 1 includes a segmented display 3, which may be any of the currently used types of display devices, such as liquid crystal, gas discharge, etc, in which segments such as 3*a* may be selectively actuated to display information in decimal numeric form. The most commonly used segmented numeric display is one such as is depicted in FIG. 1, which comprises digits of 7 segments arranged in FIG. 8 patterns of vertically aligned and horizontally aligned segments, which will display digits 0–9 and a large number of alphabetic characters as well. However, the invention also contemplates the use of a segmented alphanumeric display, such as seen, for example, in U.S. Pat. No. 3,971,012, on which a full range of decimal digits and alphabetic characters may be displayed, such displays also being well known in the art.

Display 3 is connected to a controller 4 which includes conventional driving circuits and which controls the flow of data to and from other functional components of device 1. Controller 4 may, for example, include a microprocessor, input and output data latches, power source, random access memory, and a read only memory, which is programmed to carry out the particular function desired for controller 4. An example of a commercially available integrated circuit which, when properly programmed will carry out all of the functions to be described for controller 4 in FIG. 1 is INTEL Part Number 80C51 microcontroller. A data source 5 is connected to provide input of information to controller 4 which, in turn, utilizes a decimal decoder driver 4*a* to display selected information in decimal numeric form on display 3. Data source 5 may include, for example, a timekeeping circuit of a conventional type, and providing a signal which decoder driver 4a decodes and displays in readable decimal numeric form on display 3, as hours and minutes.

Controller 4, in the embodiment shown, also is arranged to provide an output signal to key a conventional FM radio transmitter 6 having an antenna 6a. Of course, an AM or other type of radio signal could be employed, the FM transmitter being used only in this example. Controller 4 is designed to transmit a serial stream of 1's and 0's. These serve to key transmitter 6 which, in turn, shifts the frequency of a transmitted FM signal radiated from antenna 6a in a conventional manner, known as FSK modulation of the FM signal. The transmitted signal may include a first binary code word identifying the transmitter.

The second device 2 comprises a FM receiver 7 having an antenna 7a. Receiver 7 incorporates a binary decoding device 7a in which the received signal is matched with a selectable second binary code word. If the received first code matches the selectable second code in receiver 7, it causes receiver 7 to actuate an output device 8. The output device may be an alarm, a light, or telephone dialing equipment, for example.

The decoder in receiver 7 is connected to an externally accessible bank of switches 9. Each of the switches, such as the one shown at 9a, may be set in one of two positions to represent the binary digits 0 and 1. For example, on the bank of switches 9 shown in FIG. 1, the up position of the toggle switch handle represents a 0 and the down postion represents a 1, although this is an arbitrarily selected convention which could be reversed. Therefore, a binary code work 0-1-0-1-1-0-1-0 is represented by the switch positions. Setting the toggle switches in this position sets the internal decoder 7a in receiver 7 to the second binary code word. This provides an output when the first binary word 0-1-0-1-1-0-1-0 is received as part of a data frame from transmitter 6. The electronic equipment and software to accomplish the foregoing is conventional and well-known to those skilled in the art.

In accordance with the present invention, additional means are provided in device 1 to internally set the first binary code word. There is no externally accessible bank of switches on device 1 to indicate such a setting. However, in accordance with the invention the code word is displayed in binary fashion upon display 3, and is displayed in such a manner so as to facilitate setting the switches on device 2 to correspond with the code word selected for device 1. In order to accomplish this, a code setting switch device 10 is connected to an internal bank of switches 4b of controller 4, which may be either a latch or a memory location. Switching device 10 has a first push button 10a for selecting each binary digit of the code word in turn, and a second push button 10b for toggling the selected binary digit between 1 and 0. For example, external switch 10a may require controller 4 to step from one memory cell address to the next in a memory device indicated as "switches" 4b within controller 4, and external switch 10b may then provide a high or low signal to load the memory cell with a 1 or 0.

At the same time the binary digit is selected and set, in accordance with the present invention, a binary decoder driver 4c causes a binary digit to be displayed on the display 3 in the proper bit order corresponding to the selected but order in the memory cell of controller 4.

In accordance with the novel display method taught by the present invention, each of the pairs of vertically aligned vertical segments of the decimal numeric digits represents a binary digit. One segment of the pair is activated and represents a setting of a toggle switch, such as 9a on device 2 at a corresponding bit position. According to a selected convention, which is purely arbitrary, one of the pair of vertical segments in a vertical bar is activated by binary decoder driver 3c to represent a 0 and the other segment is activated to represent a *1*. For example, in display 3 shown in FIG. 1, selection of a particular bit location, such as the least significant bit may be indicated on the display by causing one of the vertically aligned vertical segments to flash, and it may be toggled to a 0 or a 1 by actuating switch 10b. Next, the switch 10a is actuated to display the selected segment position and to advance the flashing segment to the next significant bit position, whereupon it may be toggled to the upper or lower segment to represent a 0 or a 1, and so forth. On display 3 shown in FIG. 1, the actuated segments in the eight available vertical pairs of segments represent the binary word 0-1-0-1-1-0-1-0. This creates the same visual appearance as the desired setting of the switch bank 9 and aids in setting the externally accessible switches to correspond with the binary code word depicted upon display 3.

Figure 3:
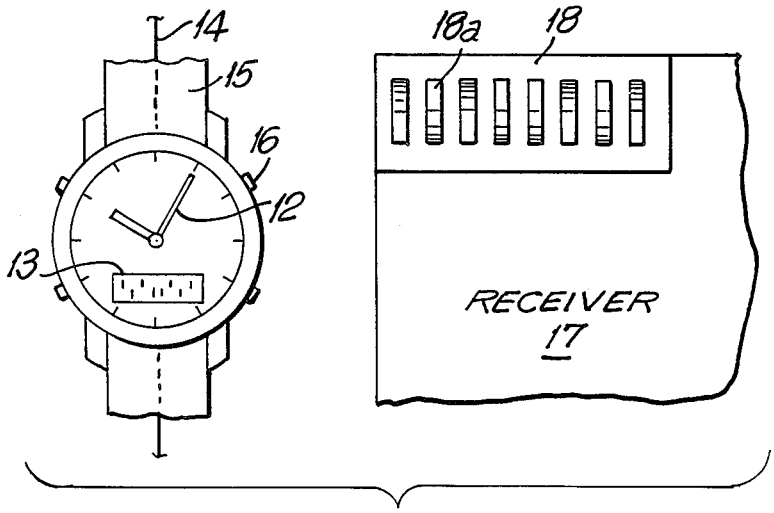
FIG. 3 is a simplified view of a digital communications system illustrating the same wristwatch together with portions of a radio receiver.
Figure 4:
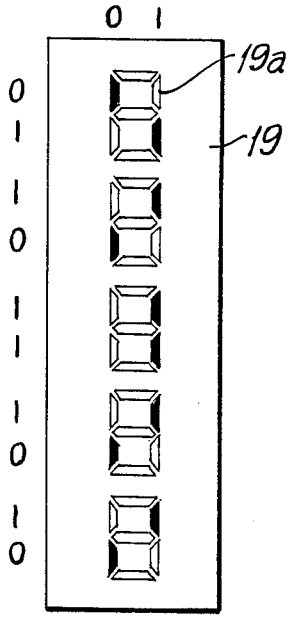
FIGS. 4 through 8 are simplified schematic drawings of modified forms of displays which may be used with the invention.
Figure 5:
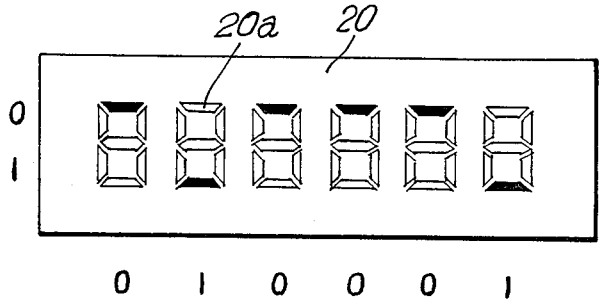

While binary digits presentation as shown in FIGS. 1 and 3 is the preferred form, due to usual arrangment of a horizontal line of numeric decimal digits and availability of two pairs of vertical segments per decimal digit, the invention is not limited to this arrangement. FIG. 4 shows a vertical decimal display 19 using the horizontally aligned vertical segments 19a to display a binary digit, reading from top to bottom of 0-1-1-0-1-1-1-0-1-0. FIG. 5 shows a horizontal decimal display 20 using the vertically aligned horizontal segments 20a to display a binary digit, reading from left to right of 0-1-0-0-0-1. Of course, a vertical decimal display using vertically aligned horizontal segments is also possible, but not shown.

Figure 6:
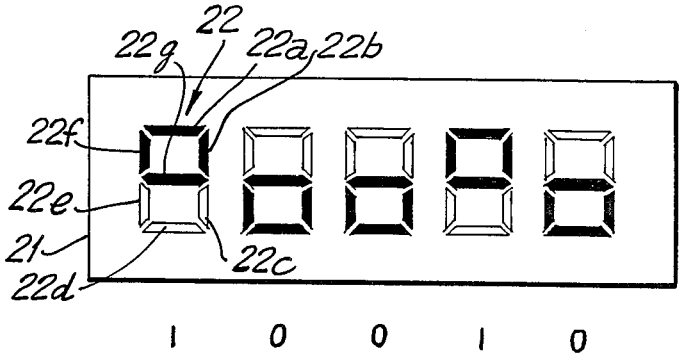

The invention is not limited to the use of a single segment in a pair of segments to indicate a switch position. For example FIG. 6 illustrates the use of a pair of vertically aligned groups of segments, where each group forms a closed pattern which would indicate a switch position. In FIG. 6 a display 21 comprises a horizontal line of numeric digits 22, each having seven segments 22athrough 22g. A first group of segments 22a, 22b, 22f, 22g form a first closed pattern. A second group of segments 22c, 22d, 22e, 22g form a second closed pattern which is vertically aligned with the first pattern. Selective actuation of either one or the other group segments by the binary decoder and driving means results in the upper or lower group of each digit being displayed. In the example shown, this represents binary word 10010, and depicts a physical appearance of a bank of two position switches corresponding to this binary code setting.

Figure 7:
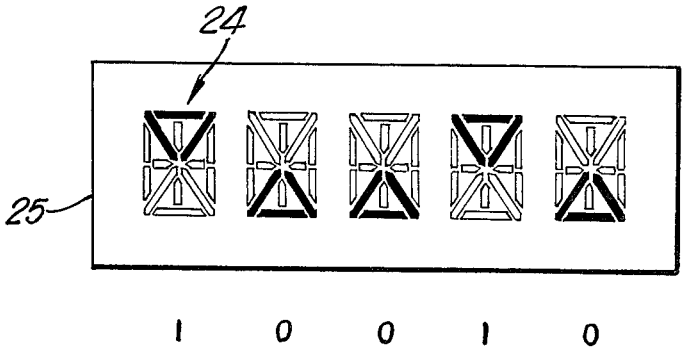
Figure 8:
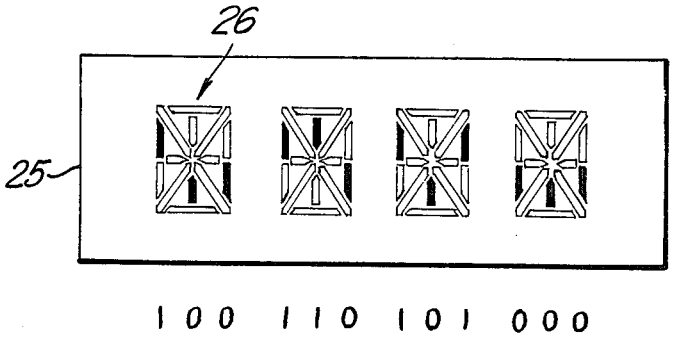

The invention is not limited to solely decimal numeric displays, but can be used with an alphanumeric display as shown in FIGS. 7 and 8.

FIG. 7 illustrates a display 23 with a horizontal line of segmented alphanumeric patterns, one of which is indicated at 24. This well-known type includes 14 segments arranged as shown to enable display of decimal numbers and all of the alphabetic characters by adding additional segments. Display 23 may be activated to display a binary word by activating either of a first or second vertically aligned group as described in connection with FIG. 6.

FIG. 8 illustrates another display 25 with a segmented alphanumeric pattern, one of which is indicated at 26. In this case, however, single vertical segments, rather than groups of segments represent switch positions, in the same manner as previously described in connection with the display shown in FIG. 1.

For purpose of definition in the appended claims, the term "set" is used to generically define a vertical segment, a horizontal segment or a group of segments forming a closed pattern. In other woeds, a set may include only one member, e.g. a vertical segment, or it may include more than one member, e.g. a group forming a closed pattern, so long as it can represent a selected switch position. A paired set represents either of two possible switch positions.

The invention finds particular application in a wristwatch transmitter which is coded so as to match only a particular receiver having the same code setting.

Figure 2:
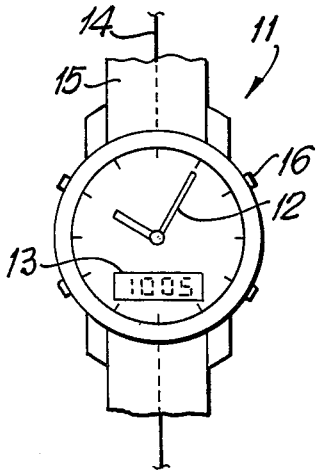
FIG. 2 is a radio transmitter wristwatch with digital display.

FIG. 2 of the drawing shows a wristwatch 11 with conventional hands 12 and a digital display 13, which may show the time or date as desired. The wristwatch also contains an FM transmitter radiating a signal from an antenna 14 contained in the wristwatch strap 15. Push buttons 16 are connected to carry out the select and toggle functions previously described, as well as to cause the watch to transmit a signal including the first binary code word. An example of a wristwatch with radio transmitter may be seen by reference to U.S. Pat. No. 4,063,410 issued Dec. 20, 1977.

FIG. 3 illustrates the same wristwatch 11 when placed in the code setting mode. It is designed to operate with a radio receiver, a portion of which is shown at 17 having an externally accessible bank of switches 18. In the preferred embodiment, these are illustrated as DIP toggle switches 18a, which may be pushed at the top or bottom to set a desired second binary code word, to which receiver 17 is receptive.

Receiver 17 may, for example, be a receiver which dials one or more telephone numbers and provides other warnings when activated. An example of such a product is the Emergency Call System of AT&T Consumer Products, which combines in one console monitoring for fire, medical, and environmental emergencies. The device has a high volume voice-synthesized warning that is broadcast in the home to allow for cancelling false alarms. In addition to receiving signals from smoke detectors, water temperature, and power signals, the device is activated by a portable radio transmitter, such as one contained in watch 11, which signals to the console to call and report the emergency.

When the watch 11 is converted to the code setting mode, by pushing buttons 16 in a manner which depends upon the design of the particular watch, display 13 will be activated in accordance with the present invention to display a binary code word setting using the upper and lower segments of the vertically aligned vertical segments on conventional decimal numeric digits. Toggle switches 18a may then be set to look exactly like the binary code setting shown on display 13. In this manner, errors in setting the receiver code to correspond to the code transmitted by watch 11 are avoided.

While there has been described what is considered to be the preferred embodiment of the invention, other modifications will occur to those skilled in the art, and it is desired to secure in the appended claims all such modifications as fall within the true spirit and scope of the invention.

I claim:

1. In a device of the type having a display with selectively actuatable segments adapted to present a line of at least two segmented patterns of said segments being arranged to display at least two numeric decimal digits, each pattern comprising at least 7 segments and having first decoding and driver means for selectively actuating said segments to display said decimal digits, the improvement comprising second decoding and driving means selectively actuating segments in paired sets of said segments to display a line representing binary numbers, said binary numbers being arranged to provide a visual aid to facilitate setting a plurality of two-position switches.

2. The improvement in accordance with claim 1, wherein said line of patterns is horizontal and wherein each binary number is represented by a vertically aligned pair of said sets.

3. The improvement in accordance with claim 2, wherein each of said paired sets comprises a pair of vertical segments.

4. The improvement in accordance with claim 2, wherein each of said paired sets comprises a pair of horizontal segments.

5. The improvement in accordance with claim 2, wherein each of said paired sets comprises first and second groups of segments, each of said groups forming a closed pattern.

6. The improvement in accordance with claim 1, wherein said line of patterns is vertical and wherein each binary number is represented by a horizontally aligned pair of said sets.

7. The improvement in accordance with claim 6 wherein each of said paired sets comprises a pair of vertical segments.

8. The improvement in accordance with claim 6, wherein each of said paired sets comprises first and second groups of segments, each of said groups forming a closed pattern.

9. The improvement in accordance with claim 1, wherein said segmented pattern comprises seven segments arranged in a FIG. 8 pattern.

10. The improvement in accordance with claim 1, wherein said segmented pattern comprises fourteen segments arranged as an alphanumeric display pattern.

11. In the device of the type having memory locations and having a display with selectively actuatable segments adapted to present a line of segmented patterns of said segments and including means providing numeric decimal data to be displayed and having decimal decoder and driver means selectively actuating said segments to display such numeric decimal data on said segmented patterns in decimal form, the improvement comprising:

switching means arranged to successively select a binary digit to be stored in said memory locations of said device and to set the value of said binary digit, and binary decoder and driving means connected to said switching means and arranged to selectively actuate segments in paired sets and to display each of said selected binary digits by actuating one segment of one of said paired sets of segments on said display for each of said binary digits.

12. The improvement according to claim 11, wherein said decimal digit form comprises selectable vertical and horizontal segments arranged in a FIG. 8 pattern, and wherein each binary digit is represented by paired sets of said vertical and horizontal segments.

13. The combination according to claim 12, wherein a paired set comprises two vertically aligned segments.

14. The combination according to claim 13, wherein said vertically aligned segments are vertical segments.

15. The combination according to claim 13, wherein said vertically aligned segments are horizontal.

16. The combination according to claim 12, wherein a paired set comprises two vertically aligned groups, each group comprising a closed pattern of segments.

17. The combination according to claim 12, wherein a paired set comprises two horizontally aligned segments.

18. the combination according to claim 17, wherein said horizontally aligned segments are vertical.

19. The combination according to claim 12, wherein a paired set comprises two horizontally aligned groups, each group comprising a closed pattern of segments.

20. In a communication system of the type having:

a first device including a segmented display and means arranged to display information indecimal numeric form comprising selectable vertical and horizontal segments arranged in a FIG. 8 pattern on said display, said first device also arranged to transmit a signal incorporating a first binary code word, a second device responsive to said signal, said second device having a plurality of externally accessible switches selectively settable to a second binary code word and arranged to provide an output signal when said first and second binary code words are the same, the improvement comprising, first means selecting and setting the individual bits in said first binary code word, and second means displaying said binary code word on said display as binary digits wherein each binary digit is represented by an activated segment of a pair of segments, and corresponding in orientation and visual perception to positions of said plurality of switches to be set on said second device.

21. The combination according to claim 20, wherein said pair of segments are vertical and are vertically aligned.

* * * * *